US008783350B2

(12) United States Patent
Snider

(10) Patent No.: US 8,783,350 B2
(45) Date of Patent: Jul. 22, 2014

(54) PROCESSES FOR FRACTURING A WELL

(75) Inventor: Philip M Snider, Houston, TX (US)

(73) Assignee: Marathon Oil Company, Houston, TX (US)

( * ) Notice: Subject to any disclaimer, the term of this patent is extended or adjusted under 35 U.S.C. 154(b) by 378 days.

(21) Appl. No.: 13/210,473

(22) Filed: Aug. 16, 2011

(65) Prior Publication Data

US 2013/0043030 A1 Feb. 21, 2013

(51) Int. Cl.
*E21B 43/27* (2006.01)
*E21B 23/04* (2006.01)

(52) U.S. Cl.
USPC ..... 166/283; 166/308.1; 166/387; 166/177.5

(58) Field of Classification Search
USPC ..... 166/283, 271, 268, 308.1, 387, 177.5, 166/319
See application file for complete search history.

(56) References Cited

U.S. PATENT DOCUMENTS 2,941,594 A * 6/1960 Byrle et al. ..... 166/276
3,398,795 A 8/1968 Elliston
3,559,736 A * 2/1971 Bombardieri ..... 166/276
4,350,203 A * 9/1982 Widmyer ..... 166/51
4,474,409 A 10/1984 Trevits et al.
4,714,117 A 12/1987 Dech
7,063,162 B2 6/2006 Daling et al.
7,066,264 B2 * 6/2006 Bissonnette et al. ..... 166/305.1
7,066,265 B2 6/2006 Surjaatmadja
2006/0000620 A1 * 1/2006 Hamilton ..... 166/387
2010/0065276 A1 * 3/2010 Fehr et al. ..... 166/308.1

* cited by examiner

*Primary Examiner* — Cathleen Hutchins
(74) *Attorney, Agent, or Firm* — Jack E. Ebel; Corey S. Tumey; Rodney F. Brown

(57) ABSTRACT

Processes and systems for fracturing a formation are disclosed. Tools that may be selectively opened and closed are positioned on a tubular liner that in turn is positioned within a subterranean well bore. Separate pairs of packers are also attached to and positioned along the tubular liner so as to straddle each tool. Fracturing fluid is pumped from the surface through the tubular and open tool and past a pair of packers at a temperature and injection rate which causes contraction of the tubular liner. Thereafter, the velocity of the fracturing fluid is sufficient to set the pair of packers adjacent the open tool. Continued pumping of fracturing fluid is directed by the set packers into the adjacent subterranean environs at a pressure sufficient to fracture the subterranean environs.

27 Claims, 4 Drawing Sheets

PROCESSES FOR FRACTURING A WELL

BACKGROUND OF THE INVENTION

1. Field of the Invention

The present invention relates to processes and systems for fracturing a subterranean environs after significant movement of tubulars in a well bore have occurred, and more particularly, to processes and systems for fracturing a subterranean environs wherein a fracturing fluid is used to set packers adjacent an opening in tubing positioned in a subterranean well bore and to fracture a subterranean formation.

2. Description of Related Art

In the production of fluid from a subterranean well, a well bore may be drilled in a generally vertical, deviated or horizontal orientation so as to penetrate one or more subterranean formations. The well is typically equipped by positioning casing which may be made up of tubular joints into the well bore and securing the casing therein by any suitable means, such as cement positioned between the casing and the walls of the well bore. Thereafter, the well may be completed in a typical manner by conveying a perforating gun or other means of penetrating casing to a position that is adjacent the subterranean formation of interest and detonating explosive charges so as to perforate both the casing and the subterranean formation. In this manner, fluid communication may be established between the subterranean formation and the interior of the casing to permit the flow of fluid from the subterranean formation into the well. Production tubing that is equipped with a packer for sealing the annulus between the casing and the production tubing may be run into the well. Care must be taken in lowering the production tubing through the fluid that is present in the well. If the velocity of formation fluid passing the production packer as the production tubing is lowered into the well is too great, the occurrence of severe suction effects or swabbing may cause deformation of the packer resulting in premature setting thereof. Accordingly, care is taken to either lower the production tubing within the well at a low enough rate to ensure against premature setting due to swabbing or to employ a packer that is designed with means, for example internal flow paths and/or mechanical locking mechanisms, that allow it to be lowered at higher speeds. Once positioned in the well, the elastomeric sealing element of the packer can be mechanically or hydraulically expanded into sealing engagement with the casing. Fluid produced from the subterranean formation into the casing can be produced to the surface via the production tubing.

Alternatively, a well may be completed as an "open hole", meaning that intermediate casing is installed and secured within the well bore by conventional means, such as cement, but terminates above the subterranean formation of interest. Typically, a tubular liner may be positioned within the well bore along the subterranean formation of interest and may be anchored to the intermediate casing near the end of the liner proximate to the well head. As positioned within the well, cement is not employed in the annulus between the tubular liner and the well bore. The well may be subsequently equipped with production tubing or casing and conventional, associated equipment so as to produce fluid from the subterranean formation of interest to the surface. As with a fully cased well, the lower casing or tubular liner may be equipped with one or more packers on the exterior thereof. This well system may also be used to inject fluid into the well to assist in production of fluid therefrom or to inject fluid into the subterranean formation to assist in extracting fluid therefrom.

Further, it is often desirable to stimulate the subterranean formation of interest to enhance production of fluids, such as hydrocarbons, therefrom by pumping fluid under pressure into the well and the surrounding subterranean formation of interest to induce hydraulic fracturing thereof. Thereafter, fluid may be produced from the subterranean formation of interest, into the well bore and through the production tubing and/or casing string to the surface of the earth. Where it is desired to stimulate or fracture the subterranean formation of interest at multiple, spaced apart locations along a well bore penetrating the formation, i.e. along an open hole, isolation means, such as packers, may be actuated in the open hole to isolate each particular location at which injection is to occur from the remaining locations. Thereafter fluid may be pumped under pressure from the surface into the well and the subterranean formation adjacent each isolated location so as to hydraulically fracture the same. The subterranean formation may be hydraulically fractured simultaneously or sequentially. Conventional systems and associated methodology that are used to stimulate subterranean formation in this manner include swellable packer systems with sliding sleeves, hydraulically set packer systems, ball drop systems, and perforate and plug systems.

In conventional open hole operations, many if not all of the isolation packers deployed on a tubular liner may be set substantially concurrently. For example, an isolation packer may include an elastomer which swells upon contact with liquid, such as formation liquid, drilling liquid or other liquids injected into the well. As these packers are set prior to injection of fracturing fluid through the production casing or tubing, the subsequent injection of fracturing fluid at relatively high rates and pressures balloons the tubular liner outwardly thereby causing the same to contract in length. Further, the injection of fracturing fluid from the well head at generally ambient temperatures, e.g. 60° F. to 70° F., and at relatively high rates does not allow sufficient time for the fracturing fluid to warm up to bottom hole temperatures, e.g. 250° F. Thus, the relative cool fracturing fluid causes the tubular liner to contract in length even more. Such contraction, which can amount up to 10 feet or more in length, often may damage the packers that were previously set thereby causing the packers to fail, i.e. leak, thereby allowing fluid communication around the packer in the annulus between the tubular liner and walls of the open hole. Also, the relatively high pressure at which the fracturing fluid is injected often causes the set packers to fail. Previous methods employed to mitigate the effects of such tubing movement, such as the use of expansion joints in the tubular liner, are expensive and have not proved to be reliable. Accordingly, a need exists for processes for stimulating intervals of a subterranean environs at spaced apart locations which minimizes failure and damage to packers used to isolate intervals that may occur due to tubing movement.

SUMMARY OF THE INVENTION

To achieve the foregoing and other objects, and in accordance with the purposes of the present invention, as embodied and broadly described herein, one characterization of the present invention may comprise a process wherein a first volume of fracturing fluid is pumped through at least a portion of tubing positioned in a subterranean well bore at a velocity sufficient to deform at least one packer that is carried on the tubing into sealing engagement with the well bore. Thereafter, the first volume of fracturing fluid is pumped at a pressure sufficient to fracture a subterranean environs.

Another characterization of the present invention may be a process for pumping a stimulation fluid through a liner positioned in an open hole of a subterranean well, wherein each packer that is positioned on the exterior of the liner is not set until substantially all movement of the liner due to a change in temperature and pressure has occurred.

A further characterization of the present invention may be a process for pumping a first volume of fracturing fluid within an annulus formed between a subterranean well bore and a tubular positioned within the subterranean well bore at a velocity sufficient to deform at least one first packer into sealing engagement with the well bore. Thereafter, at least a portion of the first volume of fracturing fluid may be pumped into the subterranean environs in proximity to the at least one first packer at a pressure sufficient to fracture the subterranean environs.

A still further characterization of the present invention may be a process for actuating at least one packer into sealing engagement with a subterranean well bore adjacent a first opened port in a tubular positioned in the subterranean well bore. The tubular has a plurality of closed ports and packers adjacent to each of the plurality of closed ports which are not actuated

BRIEF DESCRIPTION OF THE DRAWINGS

The accompanying drawings, which are incorporated in and form a part of the specification, illustrate the embodiments of the present invention and, together with the description, serve to explain the principles of the invention.

In the drawings.

DETAILED DESCRIPTION OF THE PREFERRED EMBODIMENTS

The processes and systems of the present invention may be practiced and deployed in a subterranean well 10 which may be formed by any suitable means, such as by a rotary or percussive drill string, as will be evident to a skilled artisan. The subterranean well 10 extends from the surface of the earth 13, including a sea bed or water platform or vessel, and penetrates one or more subterranean environs 18 of interest. As used throughout this description, the term "environs" refers to one or more areas, zones, horizons and/or formations that may contain hydrocarbons. The well may have any suitable subterranean configuration, such as generally vertical, generally deviated, generally horizontal, or combinations thereof, as will be evident to a skilled artisan. Once the well is formed, it may be completed by cementing a string of tubulars, i.e. a casing string, in the well and establishing fluid communication between the well and the subterranean environs of interest by forming perforations through the casing and into the environs. Such perforations may be formed by any suitable means, such as by conventional perforating guns. Thereafter, production tubing may be positioned within the well and the annulus between the production tubing and casing (or well bore in the case of an open hole completion) may be sealed, typically by means of a plurality of packer assemblies as hereinafter described. Fluids, such as oil, gas and/or water, may then be produced from the subterranean environs of interest into the well via the perforations in the casing and to the surface via production tubing for transportation and/or processing. Where the well has a generally horizontal configuration through the subterranean environs of interest, the well may be provided with intermediate casing which may be secured within the well by any suitable means, for example cement, as will be evident to a skilled artisan. The intermediate casing may extend from the surface of the earth to a point near the subterranean environs of interest so as to provide an open hole completion through a substantial portion of the subterranean environs of interest that are penetrated by well. Another tubular, such as a tubular liner, may also be positioned within the well and may be sized to extend through the intermediate casing and into the open hole of the well within the subterranean environs of interest. Such tubular liner may be uncemented through the subterranean environs of interest and anchored near one end thereof to the intermediate casing in any manner as will be evident to a skilled artisan.

Figure 1:
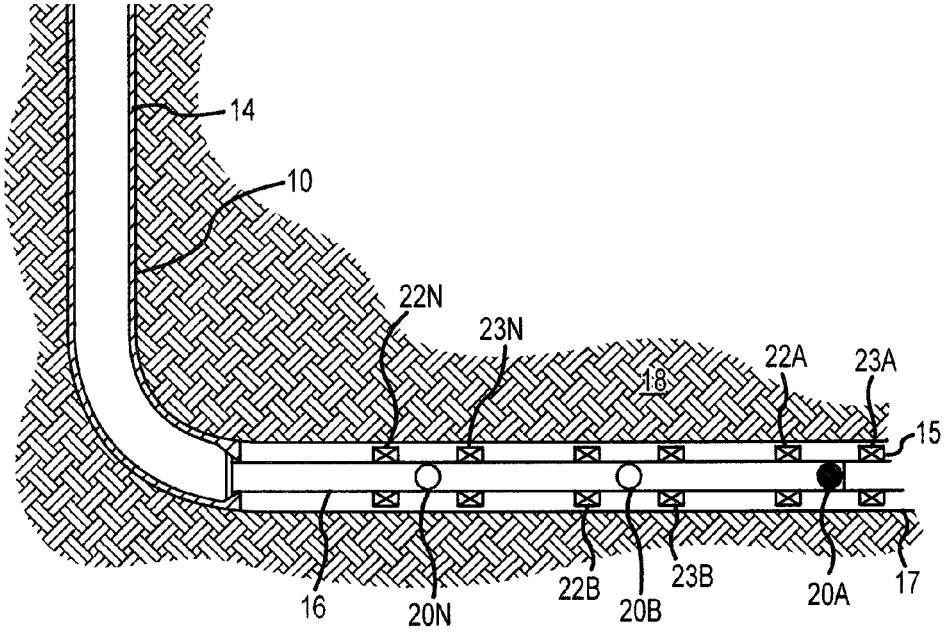
FIG. 1 is a partially cross sectional illustration of an embodiment of the present invention that utilizes tools in production tubing that may be deployed in a subterranean well and selectively open and closed.

In accordance with a broad embodiment of the present invention as illustrated in FIG. 1, a subterranean well 10 extends from the surface of the earth 13, inclusive of a sea bed or ocean platform, and penetrates one or more subterranean environs 18 of interest. Although the well 10 may have any suitable subterranean configuration as will be evident to a skilled artisan, the well is illustrated in FIG. 1 as having a generally horizontal configuration through the subterranean environs 18 of interest. The well can be provided with intermediate casing 14 which can be secured within the well 10 by any suitable means, for example cement (not illustrated), as will be evident to a skilled artisan. As will be evident to a skilled artisan, the well may be provided with other casing, for example surface casing. The intermediate casing is illustrated in FIG. 1 as extending from the surface of the earth to a point near the subterranean environs 18 of interest so as to provide an open hole through a substantial portion of the subterranean environs 18 of interest that are penetrated by well 10. A tubular liner 16 may also be positioned within the well and is sized to extend through the intermediate casing 14 and into the open hole 17 of well 10 within the subterranean environs 18 thereby defining an annulus 15 between the open hole 17 and tubular liner 16. Such tubular liner may be uncemented through the subterranean environs of interest and anchored near one end thereof to the intermediate casing in any manner as will be evident to a skilled artisan. Tubular liner 16 is further provided with a one or more tools 20A-N to selectively provide a fluid communication between the subterranean environs 18 and the interior of tubular liner 16. Although illustrated in the drawings as sliding sleeves, tools 20A-N can be any tool that is capable of selectively providing fluid communication through the side wall thereof via an opening or port, for example frac ports. The sliding sleeve in each of tools 20A-N as illustrated in the drawings may be manipulated to open and closed positions by any suitable means, for example wireline, coil tubing, radio frequency devices, ball drop, hydraulic pressure, or combinations thereof, as will be evident to a skilled artisan. As the number of tools will vary depending upon the exact application, the total number of tools that are positioned in a well and capable of being selectively opened and closed is designated by the letter "N". As liner 16 is initially positioned in the open hole 17, all sliding sleeves may be closed so that fluid may be circulated through the end of the tubular liner 16 into the toe of the well and the annulus 15 between the tubular liner and open hole so as to aid in positioning the liner 16 within the open hole. During this stage of the process, the rate of fluid circulated past the packers in the annulus is controlled to be less than that required to deform the packers.

A set of packers 22A-N, 23A-N are positioned on the tubular liner 16 adjacent to each of the tools 20A-N as close as practical to the selective opening in each tool. As the number of packers 22, 23 will vary depending upon the exact application and the total number of tools 20 that are positioned within a well, the total number of packer sets that are positioned in a well and capable of being selectively opened and closed is designated by the letter "N". The packers 22A-N, 23A-N of each set are designed to be subject to deformation or swabbing at a given pressure which can be generated by fluid flow across the packing element exceeding a predetermined velocity. Any suitable packer which can be deformed by application of sufficient fluid pressure and flow rate to the exterior thereof may be employed in the processes of the present invention as will be evident to a skilled artisan, for example conventional cup seal packers. The set of packers distal from the surface of the earth may only consist of the packer 22A since the toe or end of the well 10 may serve to direct fracturing fluid into the subterranean environs 18 adjacent tool 20A in lieu of packer 23A.

Figure 2:
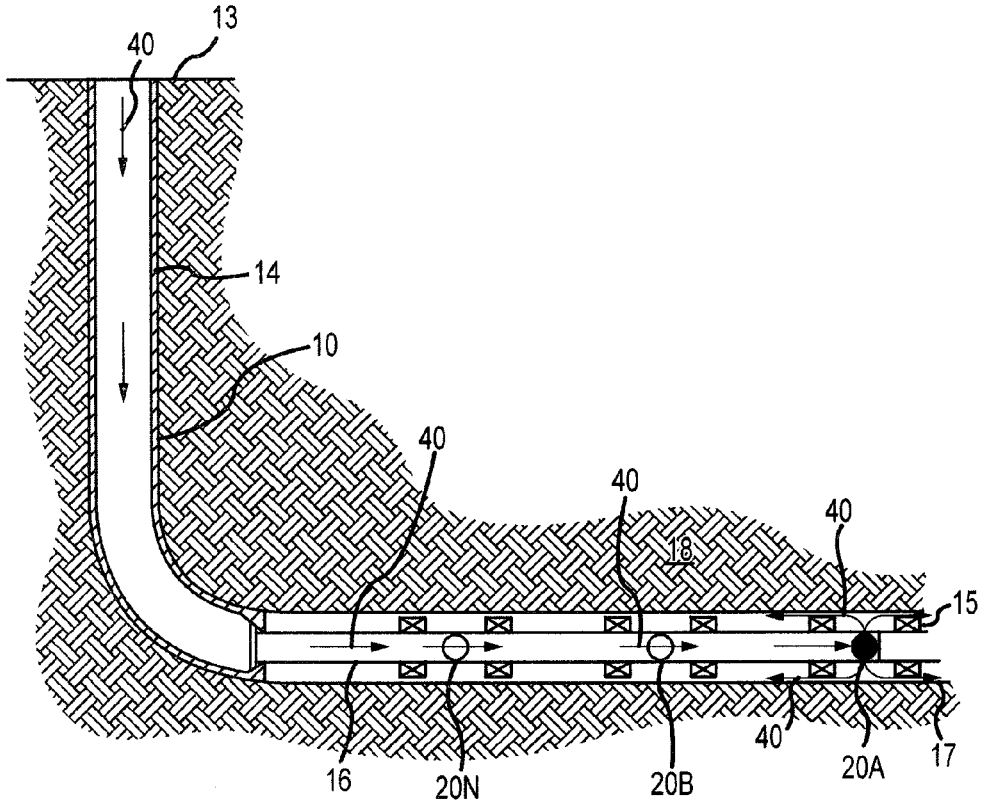
FIG. 2 is a sectional view of the embodiment of FIG. 1 illustrating pumping of fracturing fluid through production tubing, the open sleeve in a tool and into the annulus defined between production tubing and the open hole of the subterranean well.
Figure 3:
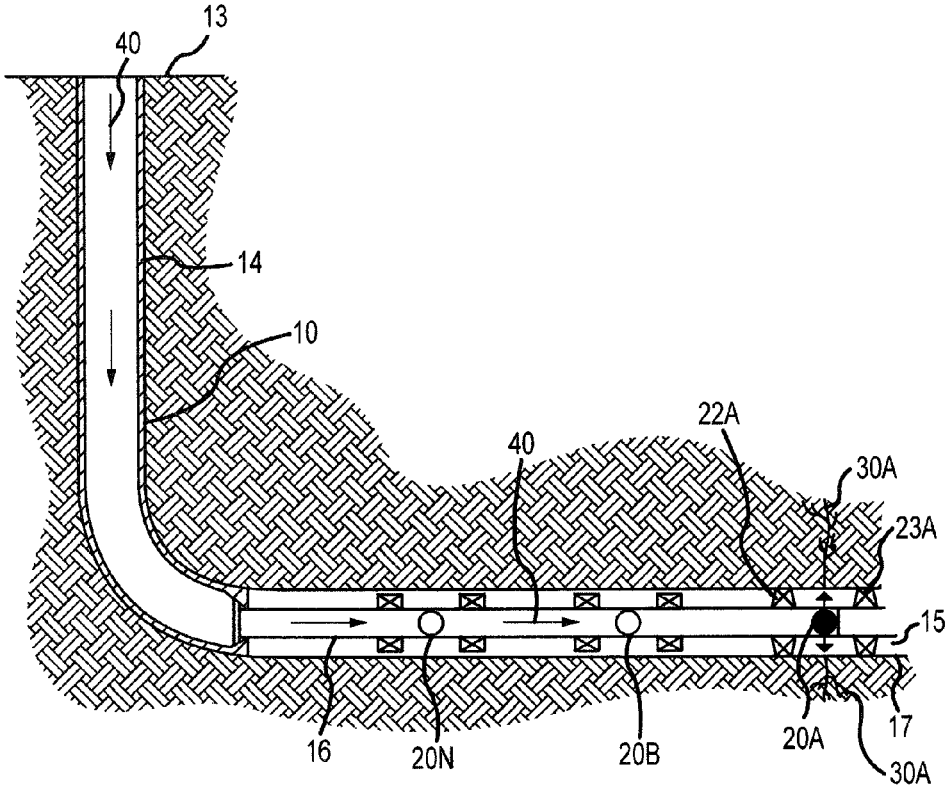
FIG. 3 is a sectional view of the embodiment of FIG. 1 illustrating pumping of fracturing fluid into the subterranean environs adjacent the open sleeve to form fractures in the environs.
Figure 4:
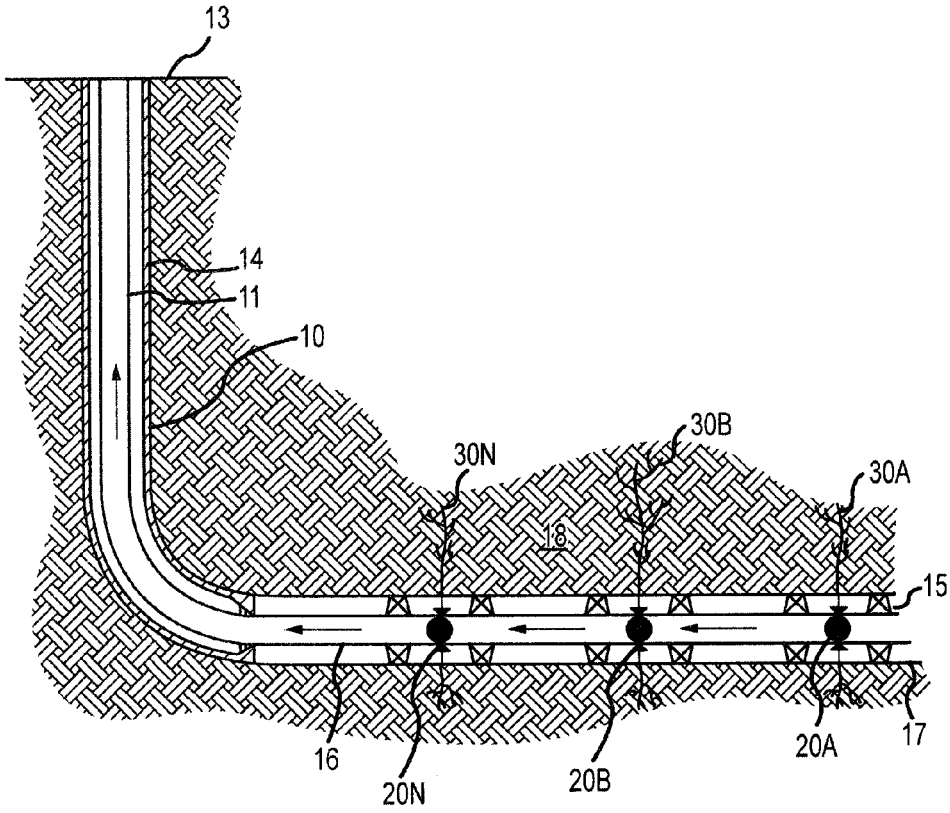
FIG. 4 is a sectional view of the embodiment of FIG. 1 illustrating fractures formed in the subterranean environs adjacent to each tool on production tubing in accordance with the processes of the present invention.

In operation, the sliding sleeve in tool 20A may be opened by any suitable means, such as by a ball dropped in intermediate casing 14 and tubular liner 16, and a suitable fracturing fluid can be pumped from the surface 13 through intermediate casing 14 and into tubular liner 16 by any suitable means as will be evident to a skilled artisan. As illustrated by arrows 40 in FIG. 1, the fracturing fluid pumped down tubular liner 16, exits the open port in tool 20A and flows in both directions within annulus 15 past the two adjacent packers 22A, 23A. The relatively cold temperature and high injection rate of the fracturing fluid causes contraction of the tubular liner as the fracturing fluid is pumped down the tubular prior to the packers being set. The velocity of the fracturing fluid in annulus 15 as the fluid flows past packers 22A, 23A is sufficiently high to cause each packer 22A, 23A to deform outwardly into sealing engagement with the open hole 17 as illustrated in FIG. 2. Depending upon the particular method employed to open the port in tool 20A, a significant amount of contraction may occur before the packers are deformed. Another method of inducing tubing movement prior to packer setting may be to pump the fracturing fluid at a rate below that sufficient to cause the packers to deform or actuate. Once the tubing has substantially contracted, the fracturing fluid rate can be increase to deform or actuate the packers. Once these packers have been deformed, the fracturing fluid is constrained from flowing in the annulus 15 past the deformed packers 22A, 23A and instead is directed into the subterranean environs 18 adjacent tool 20A under a pressure sufficient to form fractures 30A extending radially, outwardly from the open hole 17 into the subterranean environs 18 adjacent tool 20A (FIG. 3). Subsequently, the sleeve in tool 20A is closed as will be evident to a skilled artisan and the steps of opening the sleeve in a tool 20, pumping fracturing fluid through the production tubing 16 and open sleeve in the tool 20 at a velocity sufficient to deform the adjacent set of packers 22, 23, and continued pumping of the fracturing fluid until fractures 30 are created in the subterranean environs 18 adjacent the tool are repeated for each of the tools 20B-N, as desired. (See FIG. 4) Alternatively, the sleeve in tool 20A may remain open and the steps of opening the sleeve in a tool 20, pumping fracturing fluid through the production tubing 16 and open sleeve in the tool 20 at a velocity sufficient to deform the adjacent set of packers 22, 23, and continued pumping of the fracturing fluid until fractures 30 are created in the subterranean environs 18 adjacent the tool may be repeated for each of the tools, as desired. Depending on the formation type and the pump rates, the second volume can be encouraged to go through the second port in preference to the first port even with the first port still open. Or, the second volume of fracturing fluid may be prevented reaching the first port by blocking (fully or partially) the interior of the tubing between the first and second ports. Thus, the second volume is forced to exit via the second port. The blocking may be accomplished by any suitable means as will be evident to a skilled artisan, such as by means of a ball on a seat or a flapper valve. When fracturing is complete, the blockage may be removed. Thereafter, the well may be equipped with a suitable production tubing 11 which is positioned within intermediate casing 14 and sealing secured to one end of tubular liner 16 in a manner as will be evident to a skilled artisan and fluid produced from the subterranean environs 18 of interest as indicated by the arrows in FIG. 4.

The following example demonstrates the practice and utility of the present invention, but is not to be construed as limiting the scope thereof.

EXAMPLE

A well is drilled with intermediate casing set and cemented to 10,000 feet and at this depth the wellbore deviation is nearly 90 degrees, horizontal with 7" OD intermediate casing. The well is subsequently drilled to 18,000 feet measured depth by further horizontal drilling. A 4.5" OD liner is run from 18,000 feet and hung off in the 7" casing with a liner packer at 9,700 feet. As hung off the casing, this liner is positioned within the open hole and has integral sliding sleeves and packers attached to the exterior thereof. Fracturing fluids are pumped into the lowermost zone (only a single cup packer to keep fluid from moving upward above the sleeve). As this pumping continues at high pressure and with cold fluid, liner contraction occurs and the lowermost interval is fracture stimulated. A ball is dropped and the second frac sleeve is opened. Very little additional liner contraction occurs because of continual operations at substantially the same pressure rate and the same temperature of the fracturing fluids being pumped. As soon as flow at high rate exits the second port, the packers either side of the second port actuate and create a pressure barrier to keep fracturing fluids contained along a short section of the horizontal wellbore. As pressures increase, the formation fractures and fluids are injected into the formation for wellbore stimulation.

Thus, it can be readily appreciated that the processes and systems of the present invention may be employed to set packers associated with a tool that can be selectively opened and closed by use of the same fluid that is used to fracture the subterranean environs adjacent an open tool. The packers 22, 23 of the present invention can be further designed so that when deformed the packers seal the annulus 17 against flow only in one axial direction when it is desired to permit flow from an interval of unfractured subterranean environs into production tubing 16 or these packers can be designed to seal flow in both axial directions when it is desired to isolate an interval of unfractured subterranean environs from production tubing 16.

As packers used in accordance with the processes and systems of the present invention are set by the application of fracturing fluid just prior to fracturing, it will be readily appreciated that the majority of tubing movement, i.e. tubing contraction, caused by the relatively cool temperature of the high injection rate fracturing fluid occurs prior to packers being set, and thus, the problems associated with setting packers well in advance of the injection of fracturing fluid, i.e. failure due to tubing movement, are inhibited. Further, although the processes and systems of the present invention have been illustrated in FIGS. 1-4 as being applied to an open hole interval, it will be readily understood that the processes and systems of the present invention may be applied to a well that is cased at least partially through the subterranean environs of interest. It will be evident to a skilled artisan that the completion assembly and process may include other equipment, for example centralizer(s), float collar(s) and float shoe (s), and processes associated with the installation of such equipment.

While the foregoing preferred embodiments of the invention have been described and shown, it is understood that the alternatives and modifications, such as those suggested and others, may be made thereto and fall within the scope of the invention.

I claim:

1. A process comprising:

pumping a first volume of fracturing fluid through at least a portion of tubing positioned in a subterranean well bore and through a first port in the tubing at a velocity sufficient to deform two first packers that are carried on said tubing into sealing engagement with the well bore, said first port being positioned between said two first packers;

pumping said first volume of fracturing fluid through said first port at a pressure sufficient to fracture a subterranean environs; and thereafter pumping a second volume of fracturing fluid through at least the portion of tubing positioned in a subterranean well bore and through a second port in the tubing at a velocity sufficient to deform two second packers that are carried on said tubing into sealing engagement with the well bore, said second port being positioned between said two second packers.

2. The process of claim 1 wherein said first volume of fracturing fluid is directed into said subterranean environs adjacent said first port.

3. The process of claim 1 wherein said first port remains open while pumping the second volume of fracturing fluid through the second port.

4. A process comprising:

pumping a stimulation fluid through a liner positioned in an open hole of a subterranean well for a period of time sufficient to allow a majority of movement of said liner due to a change in temperature and pressure caused by the stimulation fluid to occur; and thereafter increasing the rate at which the stimulation fluid is pumped to actuate at least one packer that is positioned on the exterior of said liner.

5. The process of claim 4 wherein said open hole is substantially horizontal.

6. A process comprising:

pumping a first volume of fracturing fluid within an annulus formed between a subterranean well bore and a tubular positioned within said subterranean well bore at a velocity sufficient to deform two first packers into sealing engagement with the well bore;

pumping at least a portion of said first volume of fracturing fluid into said subterranean environs in proximity to said at least one first packer at a pressure sufficient to fracture said subterranean environs; and thereafter pumping a second volume of fracturing fluid within said annulus at a velocity sufficient to deform two second packers into sealing engagement with the well bore.

7. The process of claim 6 wherein said first volume of fracturing fluid is pumped through a first port in said tubular and said at least a portion of said first volume of fracturing fluid is directed into said subterranean environs adjacent said first port.

8. The process of claim 7 wherein said at least one first packer is two first packers and said first port is positioned between said two first packers.

9. The process of claim 6 wherein said subterranean well bore is an open hole.

10. The process of claim 6 wherein fluids produced from said subterranean environs is produced to the surface of the earth through said tubular.

11. The process of claim 10 wherein said at least one first packer is designed to inhibit flow in both directions along said annulus.

12. A process comprising:

actuating two first packers into sealing engagement with a subterranean well bore adjacent a first opened port in a tubular positioned in said subterranean wellbore, said actuation caused by the flow rate of fracturing fluid and, said tubular having a plurality of closed ports and packers adjacent to each of said plurality of closed ports which are not actuated.

13. The process of claim 12 further comprising:

actuating at least one second packer into sealing engagement with said subterranean well bore adjacent a second opened port in a the tubular positioned in said subterranean well bore.

14. A process comprising:

pumping a first volume of fracturing fluid through at least a portion of tubing positioned in a subterranean well bore at a velocity sufficient to deform at least one packer that is carried on said tubing into sealing engagement with the well bore, wherein said first volume of fracturing fluid is pumped through a first port in said tubing; and thereafter, pumping said first volume of fracturing fluid at a pressure sufficient to fracture a subterranean environs, wherein said first volume of fracturing fluid is directed into said subterranean environs adjacent said first port;

closing said first port;

pumping a second volume of fracturing fluid through at least a portion of the tubing positioned in the subterranean well bore at a velocity sufficient to deform at least one second packer that is carried on said tubing into sealing engagement with the well bore; and thereafter, pumping said second volume of fracturing fluid at a pressure sufficient to fracture a subterranean environs.

15. The process of claim 14 wherein said first volume of fracturing fluid is pumped through a second port in said tubing and said first volume of fracturing fluid is directed into said subterranean environs adjacent said second port.

16. The process of claim 15 wherein two packers are carried on said tubing and said second port is positioned between said two packers.

17. The process of claim 14 wherein said first port is closed by blocking the interior of the tubing string between the first port and the second port.

18. The process of claim 17 wherein said second volume of fracturing fluid is pumped through a second port in said tubing and said second volume of fracturing fluid is directed into said subterranean environs adjacent said second port.

19. The process of claim 18 wherein two packers are carried on said tubing and said second port is positioned between said two packers.

20. The process of claim 17 wherein said subterranean well bore is an open hole.

21. The process of claim 17 wherein fluids from said subterranean environs are produced to the surface of the earth through said tubular.

22. The process of claim 21 wherein said at least one second packer is designed to inhibit flow in both directions along said annulus.

23. The process of claim 17 wherein the interior of the tubing string is fully blocked.

24. A process comprising:

pumping a first volume of fracturing fluid through a first port in a tubular positioned within a subterranean well bore and within an annulus formed between the subterranean well bore and the tubular at a velocity sufficient to deform at least one first packer into sealing engagement with the well bore; and thereafter, pumping at least a portion of said first volume of fracturing fluid into said subterranean environs adjacent said first port and in proximity to said at least one first packer at a pressure sufficient to fracture said subterranean environs;

closing said first port;

pumping a second volume of fracturing fluid within said annulus at a velocity sufficient to deform at least one second packer into sealing engagement with the well bore; and thereafter, pumping at least a portion of said second volume of fracturing fluid into said subterranean environs in proximity to said at least one second packer at a pressure sufficient to fracture said subterranean environs.

25. The process of claim 24 wherein said second volume of fracturing fluid is directed into said subterranean environs adjacent said second port.

26. The process of claim 24 wherein said first port is closed by blocking the interior of the tubing string between the first port and the second port.

27. The process of claim 26 wherein the interior of the tubing string is fully blocked.

* * * * *

UNITED STATES PATENT AND TRADEMARK OFFICE

CERTIFICATE OF CORRECTION

PATENT NO. : 8,783,350 B2
APPLICATION NO. : 13/210473
DATED : July 22, 2014
INVENTOR(S) : Philip M. Snider It is certified that error appears in the above-identified patent and that said Letters Patent is hereby corrected as shown below:

In the Claims

Column 8, line 25: after "fluid and" delete ",".

Column 8, line 32: after "opened port in" delete "a".

Signed and Sealed this
Twenty-first Day of October, 2014

Michelle K. Lee

Michelle K. Lee
*Deputy Director of the United States Patent and Trademark Office*